US005344710A

United States Patent [19]

Jacob et al.

[11] Patent Number: 5,344,710

[45] Date of Patent: Sep. 6, 1994

[54] LOW-DENIER TWO-COMPONENT LOOP YARNS OF HIGH STRENGTH, PRODUCTION THEREOF AND USE THEREOF AS SEWING AND EMBROIDERY YARNS

[75] Inventors: Ingolf Jacob, Untermeitingen; Josef Geirhos, Bobingen, both of Fed. Rep. of Germany

[73] Assignee: Hoechst Aktiengesschaft, Fed. Rep. of Germany

[21] Appl. No.: 111,210

[22] Filed: Aug. 24, 1993

[30] Foreign Application Priority Data

Aug. 26, 1992 [DE] Fed. Rep. of Germany ..... 4228443

[51] Int. Cl.[5] ..... D02G 3/00

[52] U.S. Cl. ..... 428/370; 428/373; 428/369; 428/364; 428/399; 57/6; 57/247

[58] Field of Search ..... 428/370, 373, 364, 369, 428/399; 57/207, 228, 224, 245, 210, 6, 247

[56] References Cited

U.S. PATENT DOCUMENTS

| | | | |
|---|---|---|---|
| 3,216,187 | 11/1965 | Chantry et al. | 57/140 |
| 4,437,301 | 3/1984 | Eschenbach et al. | 57/289 |
| 4,523,426 | 6/1985 | Scott et al. | 57/247 |
| 4,615,167 | 10/1986 | Greenberg | 57/6 |
| 4,656,825 | 4/1987 | Negishi et al. | 57/247 |
| 5,083,419 | 1/1992 | Greifeneder et al. | 57/6 |
| 5,100,729 | 3/1992 | Jacob et al. | 428/370 |
| 5,146,738 | 9/1992 | Greifeneder et al. | 57/207 |

FOREIGN PATENT DOCUMENTS

| | | |
|---|---|---|
| 0344650 | 6/1989 | European Pat. Off. . |
| 0363798 | 4/1990 | European Pat. Off. . |
| 0295601 | 1/1992 | European Pat. Off. . |
| 0367938 | 4/1992 | European Pat. Off. . |
| 0472873 | 4/1992 | European Pat. Off. . |

*Primary Examiner*—Patrick J. Ryan
*Assistant Examiner*—N. Edwards
*Attorney, Agent, or Firm*—Connolly & Hutz

[57] ABSTRACT

There are described two-component loop yarns composed of core and effect filaments made of synthetic polymers, having a final tenacity of at least 30 cN/tex and a final linear density of less than 200 dtex and wherein the core and effect filaments each have a total linear density of in each case of less than 100 dtex.

The yarns described are preferably useful as sewing yarns.

They are obtainable by a process comprising the measures:

a) feeding two or more feed yarn strands made of synthetic polymers at different speeds into a texturing jet, said feed yarn strands each having a total linear density of less than 100 dtex, b) intermingling the feed yarn strands in the texturing jet under conditions to form a yarn consisting of core and effect filaments and having loops formed chiefly of effect filaments on its surface, c) withdrawing this primary two-component loop yarn under tension so that, through reduction in the loop size, said primary yarn becomes mechanically stabilized, d) heating the stabilized primary yarn to set the yarn structure, and e) choosing the total linear densities of the feed yarn strands, the difference in the transport speeds of the feed yarn strands and the intermingling, mechanical stabilization and setting conditions in such a way as to produce a two-component loop yarn having a final linear density of less than 200 dtex.

14 Claims, No Drawings

LOW-DENIER TWO-COMPONENT LOOP YARNS OF HIGH STRENGTH, PRODUCTION THEREOF AND USE THEREOF AS SEWING AND EMBROIDERY YARNS

The present invention relates to novel high strength two-component loop yarns of low linear density, adapted processes for producing them, and their use as sewing and embroidery yarns.

The field of sewing yarns has hitherto been dominated by the use of core yarns. These are yarns composed of a load-carrying filament core and a sheath, usually made of staple fibers. Such core yarns can only be made in customary, coarse counts. A recent development are loop yarns composed of a core with an effect yarn wrapped around it, which are intended as a replacement for the complicated-to-produce core yarns. Accordingly, the development of these loop yarns hitherto also focused on producing relatively coarse-count types. In some fields, for example the production of decorative and embroidery yarns, there is a need for particularly fine sewing yarns which are simple to use, including in particular under conditions of industrial fabrication and further processing. The present invention is the first time that there are provided sewing yarns which meet this requirement profile and which, having regard to the fine count, are particularly inexpensive to produce.

Loop yarns which are particularly useful as sewing yarns are known per se. Yarns of this type are described for example in EP-A-295,601, -367,938 and 363,798. These references are concerned with loop yarns having final linear densities of above 200 dtex. The lower limit for the total linear density of the core filaments is 100 dtex.

Hitherto there were reservations about the use of fine feed yarns in the production of loop yarns, since it was feared that, as the linear density of the feed yarn strands decreased, mixing and intermingling of the filaments would not be sufficient. The assumption was that the lower limit for the linear density of loop yarns obtainable by the jet texturing process was about 200 dtex.

It has now been found that the jet texturing process is suitable for producing fine loop yarns having a linear density of less than 200 dtex and that the yarns obtained are highly suitable for use as sewing yarns. In some fields of the textile and clothing industry, fine yarns of this type are particularly desired, since they make it possible to produce seams which are less noticeable and yet are very strong.

The present invention accordingly provides a two-component loop yarn composed of core and effect filaments made of synthetic polymers, having a final tenacity of at least 30 cN/tex and a final linear density of less than 200 dtex, and wherein the core and effect filaments each have a total linear density of in each case less than 100 dtex.

Preference is given to two-component loop yarns which have a final linear density of from 80 to 170 dtex, in particular of from 110 to 150 dtex.

The core yarn of the two-component loop yarns of the invention preferably has a total linear density of from 60 to 95 dtex.

The effect yarn of the two-component loop yarns of the invention preferably has a total linear density of from 30 to 95 dtex.

As mentioned earlier, the two-component loop yarn of the invention is composed of core and effect filaments. The core filaments are on average oriented to a much higher degree in the direction of the fiber axis than the effect filaments, which are intermingled and intertwined with the core filaments but which in addition, owing to their greater length, form loops which protrude from the fiber assembly and hence play a significant part in determining the textile properties and the end-use/in-service properties of the yarn according to the invention.

The total linear densities of the core and effect filaments of the loop yarn of the invention are customarily in a ratio of from 95 : 5 to 70 : 30, preferably from 90 : 10 to 80 : 20.

Core and effect filaments generally differ in their linear density. The core filament linear density is usually from 1.2 to 8 dtex, preferably from 1.5 to 5 dtex. The effect filament linear density is usually from 0.6 to 4.5 dtex, preferably from 1.4 to 3 dtex.

Within these linear density limits, the core filament linear density is preferably from 1.2 to 6, in particular from 1.5 to 3.5, times the effect filament linear density.

The loop yarn of the invention preferably has a final tenacity of more than 40 cN/tex. The final tenacity is the ratio of breaking strength and the final linear density at the moment of rupture. The final tenacity of the loop yarns of the invention is particularly preferably from 48 to 60 cN/tex.

The loop yarn of the invention preferably has a 180° C. hot air shrinkage of less than 8%, in particular less than 5%.

The loop yarn of the invention preferably has a breaking extension of less than 18%, in particular of less than 15% .

The breaking extension is the extension of the yarn at the moment of rupture.

Very particular preference is given to two-component loop yarns having a final tenacity of more than 48 cN/tex, a 180° C. hot air shrinkage of less than 5% and a breaking extension of less than 15%.

In principle, the two-component loop yarns of the invention can be produced from any synthetic spinnable polymers, for example polyamides, polyacrylonitrile, polypropylene and polyesters.

Particular preference is given to using polyester as the starting material for the yarns of the invention, in particular as the starting material for both the yarn components.

Suitable polyesters are in particular those which are obtained essentially from aromatic dicarboxylic acids, for example 1,4-, 1,5- or 2,6-naphthalenedicarboxylic acid, isophthalic acid or in particular terephthalic acid, and aliphatic diols of from 2 to 6, in particular from 2 to 4, carbon atoms, e.g. ethylene glycol, 1,3-propanediol or 1,4-butanediol, by cocondensation. It is also possible to use hydroxycarboxylic acids, e.g. p-(2-hydroxyethyl)benzoic acid, as starting materials for polyesters.

The abovementioned polyester raw materials may be modified by incorporation as cocondensed units of small amounts of aliphatic dicarboxylic acids, e.g. glutaric acid, adipic acid or sebacic acid, or of polyglycols, e.g. diethylene glycol (2,2'-dihydroxydiethyl ether), triethylene glycol (1,2-di(2-hydroxyethoxy) ethane) or else of minor amounts of higher polyethylene glycols. Another option, which affects in particular the dyeing characteristics of the two-component loop yarns of the invention, is to incorporate sulfo-containing units, for example sulfoisophthalic acid units.

It is also possible to make the loop yarns of the invention from low-flammable polyester materials, for example from phospholane-modified polyethylene terephthalate.

The upper limit for the final tenacity of the loop yarns of the invention depends on the degree of condensation chosen for the polymer, in particular polyester, used. The degree of condensation of the polymer is effected in its viscosity. A high degree of condensation, i.e. a high viscosity, leads to particularly high final tenacities.

Polyester loop yarns having a high final tenacity are obtainable using in particular high molecular weight polyesters having an intrinsic viscosity (measured in solutions in dichloroacetic acid at 25° C.) of greater than 0.65 dl/g, in particular above 0.75 dl/g. This applies at least to the core component, preferably however to both the core and the effect component.

A preferred polyester material for producing the loop yarns of the invention is polyethylene terephthalate or a copolyester containing recurring ethylene terephthalate units.

The two-component loop yarn of the invention, which is composed of core and effect filaments, is produced by jet texturing two or more feed yarn strands introduced into the jet at different rates of overfeed. The texturing medium used is a fluid, for example water or in particular a gas which is inert towards the feed yarn strands, in particular air.

The invention further provides a process for producing a two-component loop yarn composed of core and effect filaments made of synthetic polymers, comprising the measures of:

a) feeding several or in particular two feed yarn strands made of synthetic polymers at different speeds into a texturing jet, said feed yarn strands each having a total linear density of less than 100 dtex,
b) intermingling the feed yarn strands in the texturing jet under conditions to form a yarn consisting of core and effect filaments and having loops formed chiefly of effect filaments on its surface,
c) withdrawing this primary two-component loop yarn under tension so that, through reduction in the loop size, said primary yarn becomes mechanically stabilized,
d) heating the stabilized primary yarn to set the yarn structure, and
e) choosing the total linear densities of the feed yarn strands, the difference in the transport speeds of the feed yarn strands and the inter mingling, mechanical stabilization and setting conditions in such a way as to produce a two component loop yarn having a final linear density of less than 200 dtex.

Jet texturing of yarn comprises, as will be known, feeding the filament material into the texturing jet at a higher speed than it is withdrawn therefrom. The excess of the feed speed over the withdrawal speed, expressed as a percent of the withdrawal speed, is termed the overfeed. In the process of the invention, then, the yarn strands which are to be mixed with each other, and which in the finished yarn then supply the core or the effect filaments, are fed into the texturing jet at different rates of overfeed. The feed yarn strand which will constitute the core filaments of the yarn according to the invention will usually be fed into the texturing jet at an overfeed of from 3 to 10%, while the feed yarn strand which will constitute the effect filaments of the yarn according to the invention will usually be overfed at from 10 to 60%.

Owing to this difference in the rate of overfeed, longer lengths of the effect filaments are intermingled in the texturing jet with shorter lengths of the core filaments, the result being that, in the ready-produced yarn of the invention, the effect filaments form appreciably more arcs and loops than the core filaments, which extend essentially in the direction of the yarn axis. The different overfeeds further make it possible to control the final linear density of the loop yarn. The final linear density $T_s$ of the intermingled yarn is not simply the sum of the linear densities of the feed yarns; the overfeed of the two feed yarns has to be taken into account. The final linear density $T_s$ of the intermingled yarn is accordingly given by the following formula:

$$T_s = T_{st} * (1+(V_{ST}/100)) + T_E * (1+(V_E/100))$$

where $T_{ST}$ and $V_{ST}$ are the linear density and overfeed of the core feed yarn and $T_E$ and $V_E$ are the linear density and overfeed of the effect feed yarn.

The total linear densities of the feed yarn strands forming the core filaments and the effect filaments are selected in such a way that they are in a ratio of from 95 : 5 to 70 : 30, preferably from 90 : 10 to 80 : 20, and that—having regard to the overfeed and the other count-influencing process measures—they result in a final linear density of up to 200 dtex.

The linear densities of the core filaments fed into the texturing jet are usually within the range from 1.2 to 8 dtex, preferably from 1.5 to 5.0 dtex, and the linear densities of the effect filaments fed into the texturing jet are usually within the range from 0.6 to 4.5 dtex, preferably from 1.4 to 3.0 dtex. The core filament linear densities are usually chosen in such a way that they are from 1.2 to 6, preferably from 1.5 to 3.5, times the effect filament linear density.

It is customary to use feed yarn strands having different total and individual filament linear densities, at least the feed yarn for the core filament consisting of filaments having a tenacity such that the loop yarn final tenacity desired for the field of use in question can be achieved.

The feed yarns used for producing the two-component loop yarns of the invention are preferably high strength yarns in the case of the core filaments, while not only customary textile multi-filament yarns but also high strength multi-filament yarns can be used as effect filaments.

Suitable high strength multifilament yarns include shrinking and in particular low-shrinkage grades. For instance, the feed yarns used can be low orientation yarns (LOYs), partially oriented yarns (POYs) or highly oriented yarns (HOYs) made of polyester, which have been given the necessary high strength with appropriate drawing (cf. Treptow in Chemiefasern/Textilindustrie 6/1985, pp. 411 ff). Preferred polyesters for producing these high strength multifilament yarns, in particular for producing the effect yarns, have in particular intrinsic viscosities (measured as specified above) within the range from 0.65 to 0.75 dl/g or—in the case of particularly high molecular weight grades for producing the core yarns—within the range from 0.75 to 0.85 dl/g.

The feed yarns for producing the two-component loop yarns of the invention are preferably in the case of the core filaments high strength and low shrinkage yarns as described for example in DE-B-1,288,734 or EP-A-173,200.

The effect filaments used can be—as described above—customary textile multifilament yarns or—if particularly high strengths are desired for the two-component loop yarn—high strength and low shrinkage multifilament yarns as for the core filaments.

Preference is given to using core filaments which have a breaking tenacity, based on the final linear density, of at least 65 cN/tex, customarily from 65 to 90 cN/tex, in particular from 70 to 84 cN/tex.

Further preferred core filaments have an 180° C. hot air shrinkage of not more than 9%, in general from 5 to 9%, preferably from 6 to 8%.

Further preferred core filaments have a breaking extension of at least 8%, in general from 8 to 15%, preferably from 8.5 to 12%.

Particular preference is given to using two feed yarn strands which both consist of filaments having a breaking tenacity, based on the final linear density, of at least 65 cN/tex, a 180° C. hot air shrinkage of not more than 9% and a breaking extension of 10 to 15%.

If high-strength low-shrinkage two-component loop yarns are to be produced, the feed yarn(s) to be used is or are particularly preferably produced in an integrated process step which immediately precedes jet texturing and in which at least one of the feed yarns is obtained by drawing a partially oriented yarn material and an immediately subsequent, essentially shrinkage-free heat treatment. Essentially shrinkage-free means that, during the heat treatment, the yarn is preferably held at a constant length, but that shrinkage of up to 4%, in particular up to 2%, can be allowed. It has been found that the strength of the loop yarns obtained is about 5 to 20% higher when the drawing of the feed yarns is carried out as an integrated operation. It is assumed that the freshly drawn individual filaments are still flexible and are thus intermingleable particularly readily, i.e. with minimal loss of strength.

In this preferred embodiment of the process of the invention, therefore, at least one feed yarn, in particular two feed yarns, comprising a partially oriented yarn material are drawn, on one or two different drawing units, subjected to the essentially shrinkage-free heat treatment and immediately thereafter fed into the jet texturing stage. The drawing of the partially oriented yarns is carried out at a temperature of from 70 to 100° C., preferably on heated godets, at a drawing tension within the range from 10 to 30 cN/tex, preferably from 12 to 17 cN/tex (in each case based on the drawn linear density).

In a further preferred version of the process according to the invention, the drawing of the core feed yarn is carried out in an integrated process step immediately preceding jet texturing and a textile multifilament yarn is used as the effect yarn. In this embodiment, accordingly, only the feed yarn intended as the core yarn is obtained from a partially oriented yarn material, which is drawn on a drawing unit, subjected to an essentially shrinkage-free heat treatment and immediately thereafter fed into the jet texturing stage.

The essentially shrinkage-free heat treatment of the yarn following immediately on the drawing thereof is carried out at a yarn tension between 2 and 20 cN/tex, preferably at from 4 to 17 cN/tex, and at a temperature within the range from 180° to 250° C., preferably from 225° to 235° C.

This heat treatment can in principle be carried out in any known manner, but it is particularly advantageous to carry out the heat treatment directly on a heated takeoff godet.

If, in the process of the invention, two feed yarn strands are drawn immediately prior to the intermingling step, the drawing conditions for the partially oriented yarns are preferably kept as similar as possible, although differences in the drawing conditions of +/−10% can be tolerated.

After leaving the texturing jet, the primary two-component loop yarn is withdrawn under tension, so that, through reduction in the loop size, the primary yarn becomes mechanically stabilized. The withdrawal tension is usually from 0.05 to 0.4 cN/dtex, preferably from 0.15 to 0.25 cN/dtex. The tension is preferably such that the loops formed remain essentially intact, i.e. are not closed up in the manner of a flower bud to any significant extent, if at all.

Thereafter the stabilized primary yarn is heated to set the yarn structure. It is advantageous to subject the yarn to a hot air treatment at air temperatures of from 200° to 320° C., preferably from 240° to 300° C., at constant length.

The setting is preferably carried out in a way which permits gentle and ideally uniform heating of the yarn. The setting process comprises the measures of:

i) preheating a heat transfer gas to a temperature which is above the desired yarn temperature, and ii) feeding the preheated heat transfer gas into a yarn duct so that it flows into the yarn duct essentially perpendicularly to the yarn moving within the yarn duct and along such a length that the yarn heats up to the desired elevated temperature within the heating apparatus, the length of the zone of infringement of the gas on the yarn being such that, as a result of continuous removal of the boundary layer by the impinging heat transfer gas, the yarn comes into direct contact with the heat transfer gas and thus heats up very rapidly.

In this preferred setting process, the yarn is impinged on by the uniformly heated heat transfer gas over a certain length, so that the heat transport process is due more to the movement of the heat transfer gas (convection) than to heat transmission by temperature gradient. This form of impingement strips the yarn of its thermally insulating boundary layer of air over a considerable length and makes it possible for the hot heat transfer gas to release its heat to the yarn rapidly and uniformly. For this the temperature of the heat transfer gas need be only a little above the yarn temperature, since the bulk of the heat is transferred by convective air movement and only a relatively small proportion by temperature gradient. This convective form of heat transmission is very efficient and, what is more, overheating of the yarn material is avoided, making gentle and uniform heating a reality.

The heat transfer gas can be preheated in any conventional manner, for example by contact with a heat exchanger, by passing through heated tubes or by direct heating by heating spirals. The temperature of the preheated heat transfer gas is above the particular yarn temperature desired; preferably the heat transfer gas is heated to temperatures up to 20° C. thereabove and care is taken to ensure that no significant temperature drop occurs between the preheating and the actual heating of the yarn.

The hot heat transfer gas can be introduced into the yarn duct at any desired point. It is preferably introduced into the yarn duct in such a way that it can come into contact with the yarn along the entire yarn duct. The length of the impingement zone is preferably more than 6 cm, particularly from 6 to 120 cm, in particular from 6 to 60 cm.

The heat transfer gas is preferably introduced into the yarn duct perpendicularly to the yarn transport direction, the heat transfer gas on the one hand being carried along by the moving yarn and leaving the heating apparatus together with the moving yarn via the yarn outlet and, on the other, moving in the direction opposite to the yarn transport direction and leaving the heating apparatus via the yarn inlet.

In a preferred embodiment, the heat transfer gas is blown perpendicularly onto the yarn from small orifices in the middle portion of the yarn duct over a length of about ¼ to ½ of the duct length and escapes from the yarn duct in the yarn transport direction and in the opposite direction. In a similarly preferred modification of this embodiment, the gas is blown in conversely and sucked away on the opposite side.

The contacting in the heating apparatus of the moving yarn with the heat transfer gas shall take place under such conditions that the yarn heats up to the desired elevated temperature within the heating apparatus and the heat transfer gas cools down in practice only very little in the heating apparatus.

The person skilled in the art has a number of measures at his disposal for achieving these requirements. For instance, it is possible to have the heat transfer gas flow through the yarn duct at a relatively high weight per unit time, relative to the yarn weight moving through the yarn duct per unit time, so that, notwithstanding the effective and rapid transmission of heat to the yarn, the heat transfer gas cools down only slightly. In contrast to infringement on the moving yarn at virtually one spot, infringement along a certain zone ensures a particularly intensive interaction of the heating gas with the yarn, since the boundary layer between the yarn and the surrounding medium is continuously stripped away in this zone. In this way it is possible to achieve effective heating of the yarn using only a small change in the temperature of the gas. Furthermore, the temperature course of the heat transfer gas can be controlled in the conventional manner by the thermal capacity of the gas or its flow velocity.

More particularly, it is possible by single-location or group control to control the heating in such a way that the yarn is at a predetermined temperature by controlling the heating via a control circuit with one or more sensors in the vicinity of the yarn. Since the time constant of electronic control circuits is below 1 second, they make it possible to achieve a very short start-up phase, reducing the proportion of off-spec start-up material and eliminating winding waste and need to switch to saleable packages.

The temperature of the heat transfer gas in the heating apparatus generally changes only insignificantly; that is, the gas does not undergo any significant change in temperature on passing through the heating apparatus. This can be achieved with suitable insulation of the gas-conducting parts of the apparatus.

It is a particular advantage that the above-described temperature control system makes it possible to disregard the heat losses between the heating apparatus and the yarn, since the heating apparatus is controlled according to the temperature close to the yarn. This makes it possible to avoid expensive wall heating in the air duct between the heating apparatus and the yarn. Even local fluctuations in the insulating effect can be eliminated by this form of control.

The conventional setting processes for yarns having protruding filament ends or loops employ hot plates, hot rails or heated godets, which are heated to a temperature appreciably higher than the setting temperature in order to achieve sufficiently rapid heat transmission. This procedure is limited by the fact that protruding filament ends or loops in direct contact with the heater will melt, since they attain the high temperature of the heating element much more rapidly than the compact yarn, which heats up very much more slowly on account of its larger weight. The melting of the filament ends or loops results in sticky areas or deposits on the heater surface, which impair the running of the yarn. Moreover, the relatively severe shrinkage and melt effect reduces the number of loops per unit length. Incipiently melted filaments become brittle, which can lead to severe abrasion in the course of further processing, for example in the course of sewing. Setting the compact yarn at relatively high speeds while preserving the number of loops per unit length is also difficult to achieve with these methods. Even a contactless heat treatment of the yarn, for example in a heating tube, requires appreciable over-heating of the walls in order that the desired setting temperature in the compact yarn may be obtained as a result of adequate heat transmission. This gives rise to essentially the same effects and disadvantages as described above for contact heating.

It has now been found that these difficulties can be appreciably reduced by allowing a hot gas to flow onto the moving yarn by forced convection. This ensures a sufficiently rapid supply of heat to the yarn in order that the desired setting temperatures may be achieved in the compact yarn. It is a particularly great advantage that the hot gas need only be heated to a little above the setting temperature, since the transmission of heat is not solely dependent on the temperature gradient, but is essentially determined by the flow of hot gas. The minimal over-heating of the hot gas prevents premature melting of the protruding filament ends or loops, so that the setting temperature is achieved in the compact yarn without any excessively adverse effect on the heat-sensitive filament ends or loops. The upper limit for the temperature of the hot gas shall be the melting point of the protruding filament ends or loops. In the case of yarns based on polyethylene terephthalate, this upper limit is about 270° C.

In the practice of the process according to the invention, care must be taken to ensure that the total linear densities of the feed yarn strands, the difference in the feed speeds of the feed yarn strands, the conditions of the intermingling stage, such as the tension in the fed yarn or the pressure of the texturing fluid, the conditions of the mechanical stabilization stage, such as the tension in the yarn withdrawn from the texturing jet, and the conditions of the setting stage, such as the tension and the setting temperature, are chosen in such a way as to produce a two-component loop yarn having a final linear density of less than 200 dtex. The conditions for that are known per se to the person skilled in the art and can be determined in the particular case by carrying out preliminary experiments for orientation.

The two-component loop yarns of the invention combine the fine final linear density with the advantages of the conventional, coarse two-component loop yarns. For instance, the loops of the individual filaments remain completely intact outside the texturing jet and, by virtue of the entrained air, produce good sewing properties at high sewing speeds. This advantage is seen in high values for the sewing length to rupture, determined by the method known from DE-A-3,431,832. Furthermore, the two-component loop yarns of the invention give uniform dyeing along the length of the yarn, in particular the variants with drawn filaments of uniform molecular orientation.

The grades of the two-component loop yarns according to the invention where high-strength low-shrinkage core and effect feed yarns are used show distinctly higher strength than the grades of the two-component loop yarns according to the invention where filaments having different shrinkage properties are used. The use of feed yarns of the same type, moreover, simplifies the production process. If high-shrinkage feed yarns are used, it is usually initially necessary to create many more loops than the final loop yarn is to have.

It is a particular advantage that the two-component loop yarn of the invention does not have to be twisted. Despite its low final linear density, it can be used untwisted, for example as sewing yarn.

But, for example for reasons of eye appeal, it is also possible to apply a desired twist to the yarn, for example a twist of about 100 to 300 turns per meter (tpm), in the course of further processing.

The two-component loop yarns of the invention can be used for example as embroidery yarns or in particular as sewing yarns. These uses also form part of the subjectmatter of the invention.

The Examples which follow illustrate the invention without limiting it. An apparatus for producing the two-component loop yarn of the invention may have for example the following elements: a creel for the bobbins of core and effect feed yarn, two parallel drawing units with heatable entry and exit godets, whose speeds can be set separately, a texturing jet with separate feed rollers for precisely setting the overfeed yarn strands, a takeoff roller for the defined withdrawal of the jet-textured yarn, if desired a customary hot air setting means, and a pick-up bobbin.

Example 1:

The creel is mounted with a bobbin of 215 dtex 48 filament core feed yarn and a bobbin of 63 dtex 24 filament effect feed yarn. Both the feed yarns are made of polyethylene terephthalate, the intrinsic viscosity of which is 0.78 dl/g in the case of the core yarn and 0.69 dl/g in the case of the effect yarn (measured as defined above).

The two feed yarns are fed into their respective drawing units and drawn there by means of godets in a ratio of 1 : 2.3 in the case of the core feed yarn or 1 : 2.1 in the case of the effect feed yarn. The temperatures of the entry godets were 80° C. and of the exit godets 235° C. The drawing yarns were guided around the heated exit godets of the drawing units, adjusting the yarn transport speed for the two drawing units separately in such a way that the entry speed into the texturing jet was 636 m/min for the core feed yarn and 750 m/min for the effect feed yarn. The drawn linear density of the feed yarns prior to entry into the texturing jet was 93 dtex in the case of the core yarn and 30 dtex in the case of the effect yarn. The jet-textured yarn was withdrawn from the texturing jet at 600 m/min. The result is an overfeed of 6% for the core yarn and 25% for the effect yarn.

After leaving the texturing jet the loop yarn was mechanically stabilized by withdrawal at a yarn tension of 0.15 cN/dtex. The yarn was then set by passing it through a 235° C. hot air oven 140 cm in length.

The raw yarn thus obtained was wound up and then dyed.

After dyeing, which produced a level shade, the raw yarn data was as follows: final linear density: 140 dtex, final tenacity 54 cN/tex, 180° C. heat shrinkage 2%, and breaking extension 14%.

In the sewing test, the average sewing length of the dyed loop yarn is more than 4000 stitches in the forward direction and more than 2000 stitches in the reverse direction.

Example 2:

Example 1 is repeated with a 140 dtex 32 filament core feed yarn and a 63 dtex 24 filament effect feed yarn. Both the feed yarns are made up of polyethylene terephthalate, the intrinsic viscosity of which is in both cases 0.69 dl/g (measured as defined above).

The two feed yarns are fed into their respective drawing units and drawn there by means of godets in a ratio of 1 : 2.3 in the case of the core feed yarn or 1 : 2.1 in the case of the effect feed yarn. The temperatures of the entry godets were 80° C. and of the exit godets 235° C. The drawn yarns were guided around the heated exit godets of the drawing units, adjusting the yarn transport speed for the two drawing units separately in such a way that the entry speed into the texturing jet was 636 m/min for the core feed yarn and 750 m/min for the effect feed yarn. The drawn linear density of the feed yarns prior to entry into the texturing jet was 61 dtex in the case of the core yarn and 30 dtex in the case of the effect yarn. The jet-textured yarn was withdrawn from the texturing jet at 600 m/min. The result is an overfeed of 6% for the core yarn and 25% for the effect yarn.

After leaving the texturing jet the loop yarn was mechanically stabilized by withdrawal at a yarn tension of 0.15 cN/dtex. The yarn was then set by passing it through a 235° C. hot air oven 140 cm in length. The raw yarn thus obtained was wound up and then dyed.

After dyeing, which produced a level shade, the raw yarn data was as follows: final linear density: 102 dtex, final tenacity 56 cN/tex, 180° C. heat shrinkage 2.5%, and breaking extension 13%.

In the sewing test, the average sewing length of the dyed loop yarn is more than 4000 stitches in the forward direction and more than 2000 stitches in the reverse direction.

What is claimed is:

1. A two-component loop yarn composed of core and effect filaments made of synthetic polymers, having a final tenacity of at least 30 cN/tex and a final linear density of less than 200 dtex, and wherein the core and effect filaments each have a total linear density of in each case less than 100 dtex.

2. The two-component loop yarn of claim 1, having a final linear density of from 80 to 170 dtex, preferably from 110 to 150 dtex.

3. The two-component loop yarn of claim 1, wherein its core yarn has a total linear density of from 60 to 95 dtex.

4. The two-component loop yarn of claim 1, wherein its effect yarn has a total linear density of from 30 to 95 dtex.

5. The two-component loop yarn of claim 1, having a final tenacity of more than 40 cN/tex.

6. The two-component loop yarn of claim 1, having a 180° C. hot air shrinkage of less than 8%.

7. The two-component loop yarn of claim 1, having a breaking extension of less than 18%.

8. The two-component loop yarn of claim 1, having a final tenacity of more than 48 cN/tex, a 180° C. hot air shrinkage of less than 5% and a breaking extension of less than 15%.

9. The two-component loop yarn of claim 1, wherein the total linear density of core and effect filaments are in a ratio of from 95 : 5 to 70 : 30.

10. The two-component loop yarn of claim 1, wherein the core filament linear density is from 1.2 to 8 dtex, the effect filament linear density is from 0.6 to 4.5 dtex, and the core filament linear density is from 1.2 to 6 times the effect filament linear density.

11. The two-component loop yarn of claim 1, wherein the core and effect filaments are made of a polyester, in particular a polyester which has an intrinsic viscosity (measured in solutions in dichloroacetic acid at 25° C.) of greater than 0.65 dl/g.

12. The two-component loop yarn of claim 11, wherein the core filaments are made of a polyester which has an intrinsic viscosity (measured in solutions in dichloroacetic acid at 25° C.) of from 0.75 to 0.85 dl/g and the effect filaments are made of a polyester which has an intrinsic viscosity (measured in solutions in dichloroacetic acid at 25° C.) of from 0.65 to 0.70 dl/g.

13. The two-component loop yarn of claim 1, wherein the core and effect filaments are made of polyethylene terephthatate.

14. The two-component loop yarn of claim 1, wherein the core and effect filaments are made of a lowflammability polyester, in particular phospholanemodified polyethylene terephthalate.

* * * * *